United States Patent [19]

Kuwabara et al.

[11] Patent Number: 4,872,417

[45] Date of Patent: Oct. 10, 1989

[54] METHOD OF AND APPARATUS FOR AUTOMATICALLY COATING A WORKPIECE

[75] Inventors: Takasi Kuwabara; Takeo Yoshiji, both of Sakado; Masao Tegawa, Ohmiya, all of Japan

[73] Assignee: Honda Giken Kogyo Kabushiki Kaisha, Tokyo, Japan

[21] Appl. No.: 881,783

[22] Filed: Jul. 3, 1986

[30] Foreign Application Priority Data

Jul. 5, 1985 [JP] Japan ..... 60-148049

[51] Int. Cl.[4] ..... B05C 3/00

[52] U.S. Cl. ..... 118/411; 118/313; 118/697; 901/16; 901/43; 239/227; 239/243; 239/264; 239/587; 239/750; 239/752

[58] Field of Search ..... 118/323, 697, 313, 411; 901/8, 16, 24, 25, 43; 239/225.1, 243, 264, 587, 750, 751, 752, 227; 427/426

[56] References Cited

U.S. PATENT DOCUMENTS

| | | | |
|---|---|---|---|
| 2,696,449 | 12/1954 | Ericks et al. | 118/313 X |
| 2,728,238 | 12/1955 | Paasche | 239/753 X |
| 3,606,162 | 9/1971 | Lehmann | 118/323 X |
| 3,840,179 | 10/1974 | Krohn et al. | 239/1 |
| 3,908,592 | 9/1975 | Ordway et al. | 118/313 |
| 4,164,325 | 8/1979 | Watson | 239/252 |
| 4,228,958 | 10/1980 | Perry | 239/411 |
| 4,230,067 | 10/1980 | Iwamoto et al. | 118/104 |
| 4,564,410 | 1/1986 | Clitheros et al. | 118/697 X |
| 4,584,964 | 4/1986 | Engel | 118/697 |
| 4,596,509 | 6/1986 | Ise et al. | 901/16 X |
| 4,640,222 | 2/1987 | Gerber | 118/697 |

FOREIGN PATENT DOCUMENTS 8504350 3/1985 PCT Int'l Appl. .

*Primary Examiner*—Shrive Beck
*Assistant Examiner*—Alain Bashore
*Attorney, Agent, or Firm*—Birch, Stewart, Kolasch & Birch

[57] ABSTRACT

An automatic coating apparatus has a plurality of nozzle devices movable in X-, Y-, and Z-axis directions along tracks over a workpiece to be coated. One of the nozzle devices is displaceable with respect to the other nozzle device. Different coating materials are ejected from the nozzle devices toward the workpiece. Each of the nozzle devices has a nozzle which can be opened and closed by a valve operated by a cylinder mechanism. While a coating material is being ejected from one of the nozzle devices, the other nozzle device is closed. By thus selectively opening and closing the nozzle devices, the different coating materials can be coated successively on the workpiece.

10 Claims, 4 Drawing Sheets

METHOD OF AND APPARATUS FOR AUTOMATICALLY COATING A WORKPIECE

BACKGROUND OF THE INVENTION

The present invention relates to a method of and an apparatus for automatically coating a workpiece, and more particularly to a method of and an apparatus for automatically coating a workpiece selectively with a plurality of coating materials which can be ejected respectively from a plurality of nozzles directed toward the workpiece and mounted on movable units that can travel along tracks over the workpiece, so that the workpiece can efficiently be coated with the coating materials irrespective of the directions in which the workpiece is transferred into and out of the coating area.

Automotive parts such as an engine hood, a trunk lid, a roof, a door, for example, are coated along their perpheral edges with any of various coating materials such as a highly viscous sealing agent and an adhesive to make the perpheral edges resistant to rust and improve their mechanical strength or rigidity. These coating materials are selected to meet the intended functions of the workpieces to be coated. Generally, a plurality of coating materials are successively coated on a single workpiece.

FIG. 1 of the accompanying drawings illustrates a typical workpiece to be coated, i.e., the reverse side of an automotive engine hood 2. The engine hood 2 has peripheral edges 4 to be held against an automotive body (not shown), the peripheral edges 4 being coated with an adhesive to keep their mechanical strength or rigidity or render them rust-resistant. Various portions 6 of the reverse side of the engine hood 2 are coated with a mastic sealer of high shock absorbing capability for absorbing the vibration of reinforcing members attached to the reverse side of the engine hood 2.

These peripheral edges and portions are conventionally been coated by an automatic coating apparatus having a nozzle for ejecting a coating material. One such automatic coating apparatus is disclosed in Japanese Laid-Open Patent Publication No. 59(1984)-12778. The disclosed automatic coating apparatus comprises an articulated robot having a nozzle for ejecting a coating material and an arm having on its end a gripper which grips the nozzle, the arm being controlled to move the gripper to a desired position.

In operation, the gripper which grips the nozzle is moved by the arm over a workpiece, while the coating material is being ejected from the nozzle to coat the workpiece.

When a different coating material is to be coated on the workpiece, the nozzle is moved by the arm to a replacement position after the preceding coating process, and then is detached from the gripper. A nozzle for ejecting the next desired coating material is now mounted on the gripper, and thereafter is moved by the arm to a desired position over the wrokpiece, followed by a next coating process.

However, each time coating materials are to be changed, the arm must be moved to the replacement position for replacing the nozzle on the gripper. Since the coating operation of the conventional coating apparatus is interrupted during each process of a nozzle replacement operation, the efficiency of the coating operation is quite low. Other problems associated with the prior coating apparatus concern the positioning of the robot on a floor surface. This arrangement imposes limitations on the direction in which workpieces to be coated can be delivered into and out of the coating apparatus, and the robot takes up a relatively large space in the factory.

U.S. Pat. No. 4,564,410 issued Jan. 14, 1986 to Clitheros et al. discloses an adhesive application apparatus for coating an adhesive on an automotive window frame. The adhesive application apparatus has an adhesive-ejecting nozzle movable along guide rails arranged in X and Y directions, the nozzle being also movable in a Z direction. The nozzle can therefore apply an adhesive to a workpiece irrespective of the directions in which the workpiece is transferred into and out of the adhesive application apparatus.

The above prior adhesive application apparatus is however disadvantageous in that since only the single nozzle is attached, different adhesives cannot be changed quickly.

It is a general object of the present invention to provide a method of and an apparatus for automatically coating a workpiece with coating materials that can be ejected respectively from a plurality of nozzles which are displaceable so as to be directed toward the workpiece, the nozzles being selectively operable to coat a desired coating material on the workpiece for meeting a particular subsequent process to be effected on the workpiece, so that the workpiece can highly efficiently be coated in a small space with coating materials that can easily be changed, irrespective of the directions in which the workpiece is transferred into and out of the coating area.

Another object of the present invention is to provide a method of automatically coating a workpiece, comprising the steps of positioning a first nozzle of a first nozzle device closely to the workpiece; displacing the first nozzle device with respect to the workpiece while ejecting a first coating material from the first nozzle toward the workpiece; after the first coating material has been coated on the workpiece, moving the first nozzle device away from the workpiece; positioning a second nozzle of a second nozzle device closely to the workpiece; displacing the second nozzle device with respect to the workpiece while ejecting a second coating material from the second nozzle toward the workpiece; and after the second coating material has been coated on the workpiece, returning the first and second nozzle devices in unison back to respective original positions thereof.

Still another object of the present invention is to provide an apparatus for automatically coating a workpiece, comprising at least one first track; at least one Y-axis mobile body movable on and along the first track; at least one second track mounted on the Y-axis mobile body and extending substantially perpendicularly to the first track; at least one X-axis mobile body movable on and along the second track; at least one third track mounted on the X-axis mobile body and extending substantially perpendicularly to the first and second tracks; at least one Z-axis mobile body movable on and along the third track; and a plurality of nozzle devices mounted on the Z-axis mobile body and displaceable so as to be directed toward the workpiece.

A still further object of the present invention is to provide an apparatus for automatically coating a workpiece, including four X-axis mobile bodies, four Y-axis mobile bodies, four Z-axis mobile bodies, the X-axis, Y-axis, and Z-axis mobile bodies being arranged in confronting pairs, and a pair of nozzle devices mounted on each of the Z-axis mobile bodies.

Yet another object of the present invention is to provide an apparatus for automatically coating a workpiece, wherein one of the nozzle devices is displaceable with respect to the other nozzle device, the nozzle devices having respective nozzles for ejecting different coating materials.

Yet still another object of the present invention is to provide an apparatus for automatically coating a workpiece, wherein the nozzle devices have respective nozzles extending parallel to the Z-axis mobile body.

A yet still further object of the present invention is to provide an apparatus for automatically coating a workpiece, wherein the nozzle devices have respective nozzles inclined to the direction of travel of the Z-axis mobile body and angularly displaced in close relationship to each other.

Still another object of the present invention is to provide an apparatus for automatically coating a workpiece, wherein the nozzle devices can freely be inclined to the Z-axis mobile body.

Still another object of the present invention is to provide an apparatus for automatically coating a workpiece, wherein the different coating materials are a mastic sealer and an adhesive, respectively.

A still further object of the present invention is to provide an apparatus for automatically coating a workpiece, wherein the workpiece is an automotive engine hood, the mastic sealer and the adhesive being applied to prescribed portions of the automotive engine hood.

A yet still further object of the present invention is to provide an apparatus for automatically coating a workpiece, wherein the X-axis, Y-axis, and Z-axis mobile bodies include respective servomotors for moving the X-axis, Y-axis, and Z-axis mobile bodies along the first, second, and third tracks, respectively.

A still further object of the present invention is to provide an apparatus for automatically coating a workpiece, including a cylinder mechanism for moving the nozzle devices with respect to each of the Z-axis mobile bodies.

A yet still further object of the present invention is to provide an apparatus for automatically coating a workpiece, wherein each of the nozzle devices comprises a cylinder mechanism, a valve openable and closable by the mechanism, a nozzle openable and closable by the valve, and means for delivering a coating material to the nozzle via the valve, whereby the amount of the coating material ejected from the nozzle can be regulated by operating the cylinder mechanism to adjust the opening of the valve.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
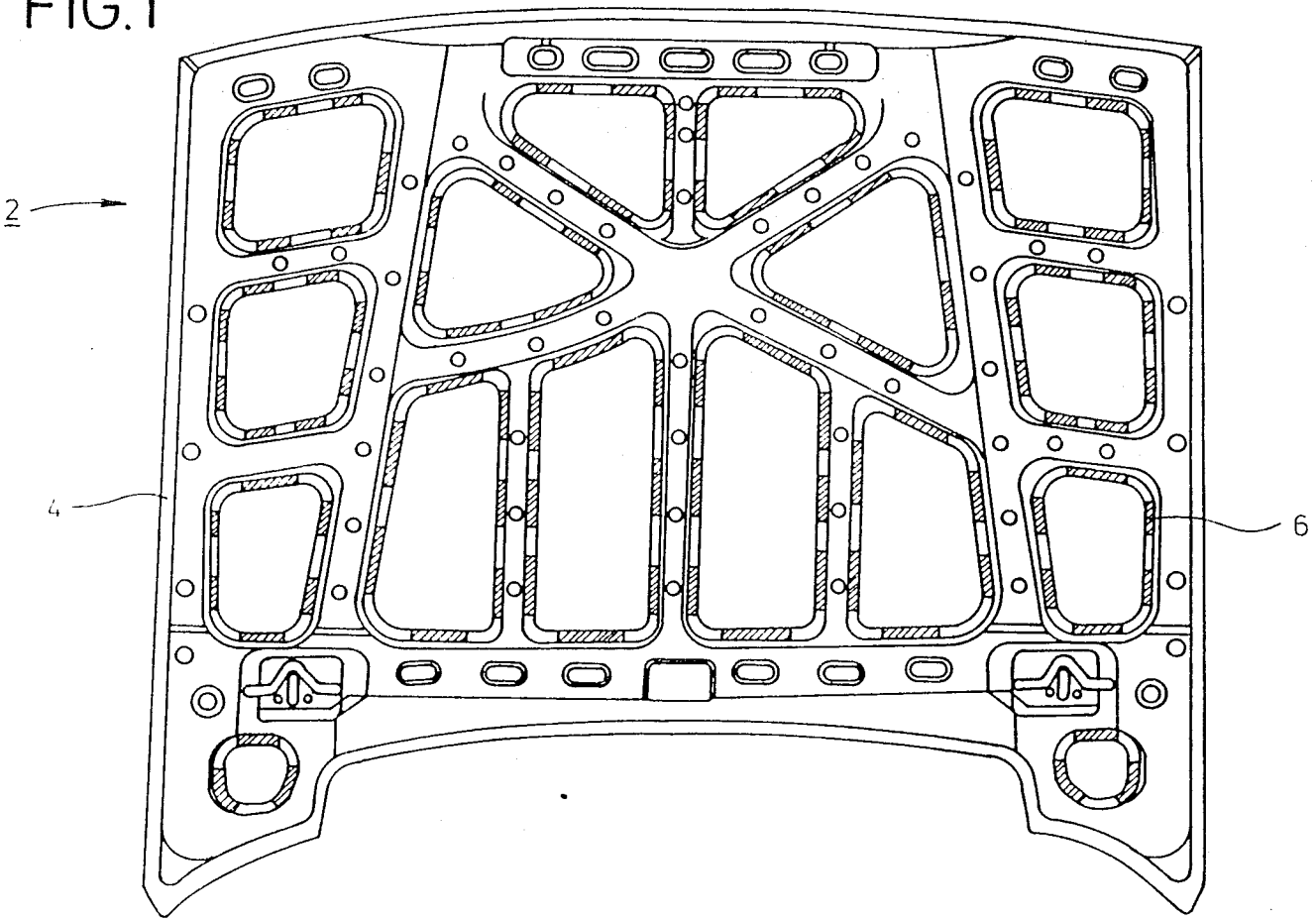
FIG. 1 is a rear view of an automotive engine hood as an example of a workpiece to be coated.
Figure 2:
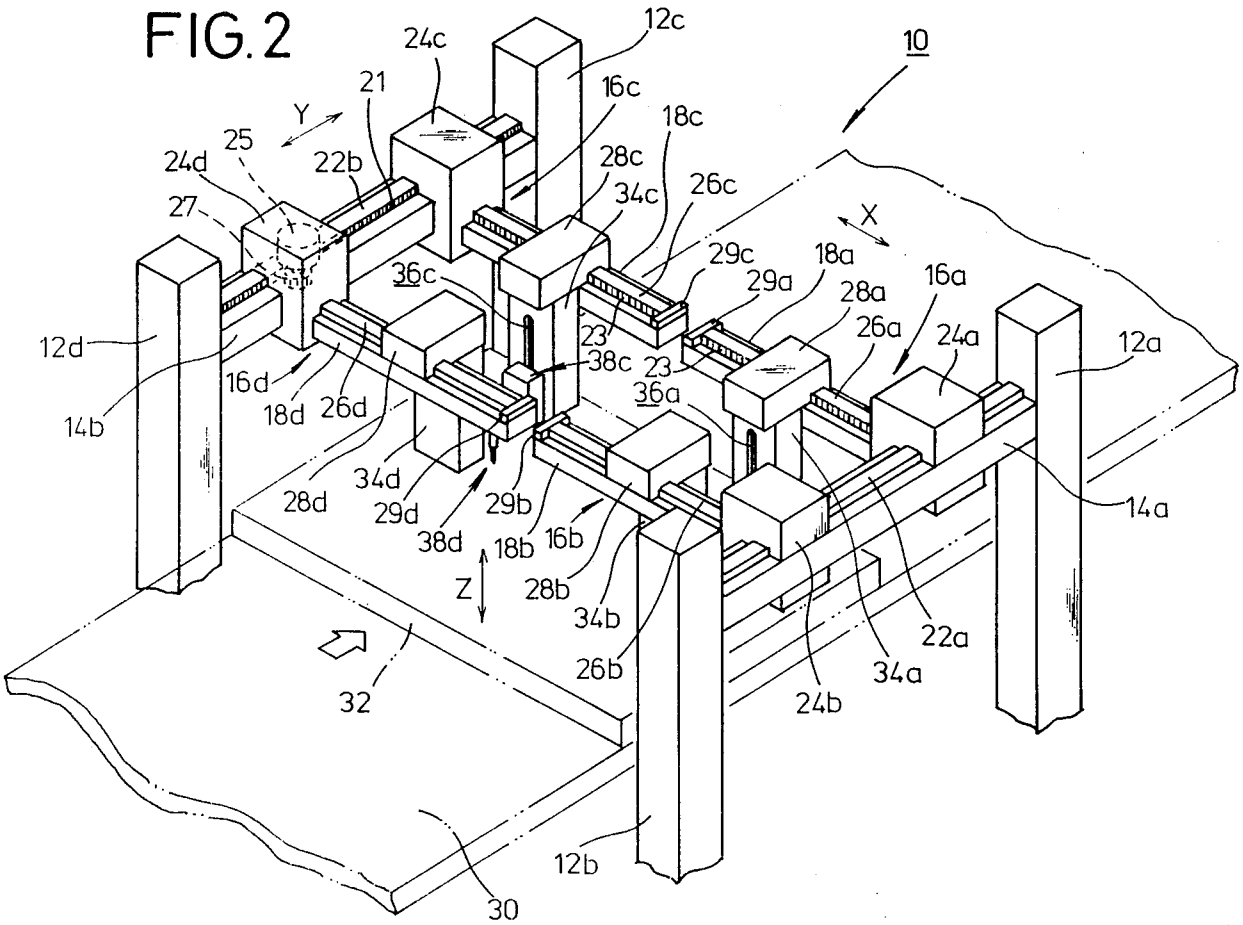
FIG. 2 is a perspective view of a main assembly of an automatic coating apparatus according to the present invention.

FIG. 2 illustrates a main assembly 10 of an automatic coating apparatus according to the present invention. The main assembly 10 comprises four vertical columns 12*a* through 12*d* supported on a floor (not shown) and positioned at the respective corners of a square, and tracks 14*a* through 14*b* extending between and joined to the columns 12*a*, 12*b* and the columns 12*c*, 12*d*. Mobile units 16*a*, 16*b* are movably mounted on the track 14*a*, whereas mobile units 16*c*, 16*d* are movably mounted on the track 14*b*. The mobile units 16*a* through 16*d* comprise, respectively, self-propelled Y-axis mobile bodies 24*a* through 24*d* movable on the tracks 14*a*, 14*b*, self-propelled X-axis mobile bodies 28*a* through 28*d* movable respectively on tracks 18*a* through 18*d* extending in an X-axis direction from the respective Y-axis mobile bodies 24*a* through 24*d*, and self-propelled Z-axis mobile bodies 38*a* through 38*d* movable respectively on tracks 34*a* through 34*d* extending in a Z-axis direction from the respective X-axis mobile bodies 28*a* through 28*d*. Guides 22*a*, 22*b* each having a rack 21 are mounted on the tracks 14*a*, 14*b*, respectively, and similarly guides 26*a* through 26*d* each having a rack 23 are mounted on the tracks 18*a* through 18*d*, respectively. Guide grooves 36*a* through 36*d* are defined respectively in the tracks 34*a* through 34*d*. Each of the Y-axis mobile bodies 24*a* through 24*d* has a self-propelling motor 25 having a rotatable driver shaft on which there is fixedly mounted a pinion 27 meshing with one of the racks 21 on the guides 22*a*, 22*b*. Therefore, the X-axis mobile body 28*a* and the Z-axis mobile body 38*a* are movable in unison in the Y-axis direction upon energizaton of the motor 25 disposed in the Y-axis mobile body 24*a*. Likewise, the X-axis mobile body 28*b* and the Z-axis mobile body 38*b*, the X-axis mobile body 28*c* and the Z-axis mobile body 38*c*, and X-axis mobile body 28*d* and the Z-axis mobile body 38*d* are respectively movable in unison in the Y-axis direction upon energizaton of the motors 25 disposed in the Y-axis mobile body 24*b* through 24*d*.

The tracks 18*a* through 18*d* having ends fixed to the Y-axis movable bodies 24*a* through 24*d*, respectively, are of a length slightly smaller than substantially half of the distance between the columns 12*a*, 12*c* or the columns 12*b*, 12*d*. The tracks 18*a* through 18*d* have their longitudinal axes extending parallel to the floor and at a right angle to the tracks 14*a*, 14*b*. The X-axis mobile bodies 28*a* through 28*d* are held in engagement with the respective guides 18*a* through 18*d* for sliding movement along the respective guides 26*a* through 26*d*. The X-axis mobile bodies 28*a* through 28*d* have self-propelling motors (not shown), respectively, similar to the motors 25 and having pinions meshing with the racks 23 of the guides 26*a* through 26*d* on the tracks 18*a* through 18*d*. Therefore, the X-axis mobile bodies 28*a* through 28*d* are movable in the direction of the arrow X upon energization of the motors. The guides 26*a* through 26*d* have ends engaging the Y-axis mobile bodies 24*a* through 24*d*, respectively, and opposite ends terminating at stoppers 29*a* through 29*d*, respectively, secured to the distal ends of the tracks 18*a* through 18*d*. A workpiece 32 to be coated, such as an engine hood, is transferred by a conveyor 30 and positioned thereby between these mobile bodies and the floor.

Figure 3:
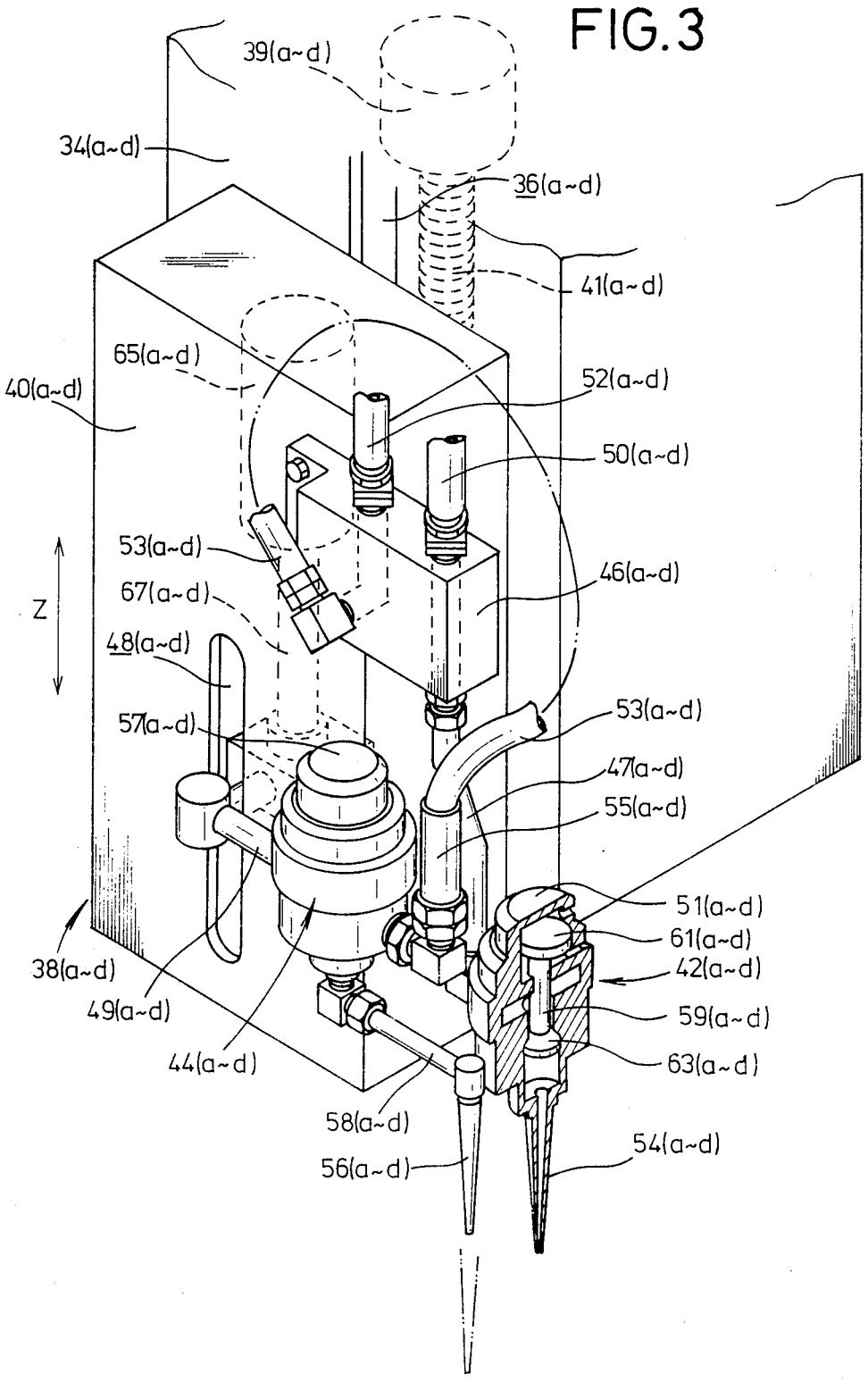
FIG. 3 is an enlarged fragmentary perspective view, partly in vertical cross section, of a Z-axis mobile body of the automatic coating apparatus of the present invention.

The tracks 34*a* through 34*d* with their longitudinal axes directed toward the workpiece 32 have upper ends secured to the X-axis mobile bodies 28*a* through 28*d*, respectively, each of the tracks 34*a* through 34*d* housing a servo drive mechanism. The guide grooves 36*a* through 36*d* are defined longitudinally in the tracks 34*a* through 36*d*, respectively, with the Z-axis mobile bodies 38*a* through 38*d* disposed over the guide grooves 36*a* through 36*d*, respectively. As shown in FIG. 3, the servo drive mechanisms essentially comprise servomotors 39*a* through 39*d* respectively, and ball screws 41*a* through 41*d*, respectively, coupled to the rotatable driver shafts of the servomotors 39*a* through 39*d*, the Z-axis mobile bodies 38*a* through 38*d* being held in threaded engagement with the ball screws 41*a* through 41*d*, respectively. When the servomotors 39*a* through 39*d* are energized to rotate the ball screws 41*a* through 41*d*, respectively, the Z-axis mobile bodies 38*a* through 38*d* can be moved in the Z-axis direction.

FIG. 3 shows one of the Z-axis mobile bodies 38*a* through 38*d* which are structurally identical to each other. The Z-axis mobile bodies 38*a* through 38*d* comprise coating units 40*a* through 40*d*, respectively, which are movable in the Z-axis direction along the guide grooves 36*a* through 36*d* by the servo drive mechanisms disposed respectively in the tracks 34*a* through 34*d*, as described above. Nozzle devices 42*a* through 42*d* and 44*a* through 44*d* are mounted on the coating units 40*a* through 40*d*, respectively.

The nozzle devices 42*a* through 42*d* are fixed to the coating units 40*a* through 40*d*, respectively, by means of rectangular support members 46*a* through 46*d*, respectively, and rigid tubes 47*a* through 47*d*, respectively. These nozzle devices 42*a* through 42*d* include air cylinders 51*a* through 51*d*, respectively, and nozzles 54*a* through 54*d*, respectively. The air cylinders 51*a* through 51*d* have piston rods 59*a* through 59*d*, respectively, pistons 61*a* through 61*d* attached to ends of the piston rods 59*a* through 59*d*, respectively, and valves 63*a* through 63*d* formed on the opposite ends of the piston rods 61*a* through 61*d*, respectively. Under air pressure introduced in the air cylinders 51*a* through 51*d*, the piston rods 59*a* through 59*d* are axially displaced to seat and unseat the valves 63*a* through 63*d* for thereby closing and opening the nozzles 54*a* through 54*d*. Flexible tubes 50*a* through 50*d* are connected to the support members 46*a* through 46*d*, respectively, and also coupled through the support members 46*a* through 46*d* to the rigid tubes 47*a* through 47*d*, respectively.

The other nozzle devices 44*a* through 44*d* are supported respectively by arms 49*a* through 49*d* projecting through guide slots 48*a* through 48*d*, respectively, defined in the coating units 40*a* through 40*d* and extending in the Z-axis direction. The nozzle devices 44*a* through 44*d* are movable in the Z-axis direction by cylinder mechanisms disposed respectively in the coating units 40*a* through 40*d*. More specifically, cylinders 65*a* through 65*d* are disposed respectively in the coating units 40*a* through 40*d* and have respective piston rods 67*a* through 67*d* with their lower ends fixed to the inner ends of the arms 49*a* through 49*d*, respectively. The nozzle devices 44*a* through 44*d* are moved in the Z-axis direction when the cylinders 65*a* through 65*d* are operated. The nozzle devices 44*a* through 44*d* comprise, respectively, air cylinders 57*a* through 57*d* identical to the air cylinders 51*a* through 51*d* and nozzles 56*a* through 56*d* mounted on distal ends of tubes 58*a* through 58*d*, respectively, attached to the air cylinders 57*a* through 57*d*. Flexible tubes 52*a* through 52*d* are connected to the support members 46*a* through 46*d*, respectively, from which flexible tubes 53*a* through 53*d* extend respectively. The flexible tubes 53*a* through 53*d* are curved arcuately and have ends joined to tube joints 55*a* through 55*d*, respectively, connected to the nozzle devices 44*a* through 44*d*, respectively.

The automatic coating apparatus according to the present invention, which carries out an automatic coating method of the invention, will operate as follows:

The workpiece 32 to be coated is transferred by the conveyor 30 in the direction of the arrow and positioned in place in the main assembly 10. The workpiece 32 may be transferred in other directions. For example, it may be transferred in a direction normal to the direction of the arrow, i.e., in a direction from a position between the columns 12*a*, 12*b* toward a position between the columns 12*c*, 12*d*, and then located in the main assembly 10. With the workpiece 32 thus positioned in the main assembly 10, the mobile units 16*a* through 16*d* start moving toward positions for starting to coat the workpiece 32. More specifically, the mobile units 16*a* through 16*d* are moved in the Y-axis direction along the tracks 14*a*, 14*b* by the self-propelling motors 25 of the Y-axis mobile bodies 24*a* through 24*d*. Then, the X-axis mobile bodies 28*a* through 28*d* are driven by their self-propelling motors (not shown) to move in the X-axis direction along the respective tracks 18*a* through 18*d*. As a result, the nozzle devices 42*a* through 42*d* and 44*a* through 44*d* of the mobile units 16*a* through 16*d* are positioned in their respective coating-start positions in an X-Y plane.

Thereafter, the nozzle devices 44*a* through 44*d* are first moved upwardly in the Z-axis direction along the respectively guide slots 48*a* through 48*d* by the cylinders 65*a* through 65*d* disposed in the coating units 40*a* through 40*d*, such that the nozzles 54*a* through 54*d* of the nozzle devices 42*a* through 42*d*, respectively, will be positioned more closely to the workpiece 32 than the nozzles 56*a* through 56*d*, respectively. The nozzle devices 42*a* through 42*d* and the nozzle devices 44*a* through 44*d* which are thus relatively positioned are indicated by the solid lines in FIG. 3.

The Z-axis mobile bodies 38*a* through 38*d* with the nozzle devices 42*a* through 42*d* and 44*a* through 44*d* thus positioned with respect to each other are then moved downwardly in the Z-axis direction along the guide grooves 36*a* through 36*d*, respectively, by the ball screws 41*a* through 41*d* that are rotated by the servomotors 39*a* through 39*d*, respectively, of the servo drive mechanisms in the tracks 34*a* through 34*d*, so that the nozzles 54*a* through 54*d* will be positioned directly above the workpiece 32.

The nozzle devices 42*a* through 42*d* are then moved along respective paths determined by the movement of the mobile units 16*a* through 16*d* in the Y-axis direction along the tracks 14*a*, 14*b*, the movement of the X-axis mobile bodies 28*a* through 28*d* in the X-axis direction along the tracks 18*a* through 18*d*, and the movement of the Z-axis mobile bodies 38*a* through 38*d* in the Z-axis direction along the tracks 34*a* through 34*d*.

While the nozzle devices 42*a* through 42*d* are being thus moved, they apply a coating material such as a mastic sealer, for example, to the workpiece 32. The coating material is delivered via the flexible tubes 50*a* through 50*d* and the rigid tubes 47*a* through 47*d* to the nozzle devices 42*a* through 42*d*. Air pressure is introduced into the air cylinders 51*a* through 51*d* to move the pistons 61*a* through 61*d* to cause the piston rods 59*a* through 59*d* to open the valves 63*a* through 63*d*. Therefore, the coating material is ejected from the nozzles 54*a* through 54*d* and applied to the workpiece 32.

After the coating material has been applied by the nozzle devices 42*a* through 42*d*, the Z-axis mobile bodies 38*a* through 38*d* are lifted by the ball screws 41*a* through 41*d* along the guide grooves 36*a* through 36*d* of the tracks 34*a* through 34*d*. Then, the nozzle devices 44*a* through 44*d* are lowered in the Z-axis direction along the guide slots 48*a* through 48*d* by the cylinders 65*a* through 65*d*. of the coating units 40*a* through 40*d* until the nozzles 56*a* through 56*d* of the nozzle devices 44*a* through 44*d* are positioned more closely to the workpiece 32 than the nozzles 54*a* through 54*d* of the nozzle devices 42*a* through 42*d*. Another coating material such as an adhesive is then ejected from the nozzle devices 44*a* through 44*d*. More specifically, the coating material is delivered to the nozzle devices 44*a* through 44*d* via the flexible tubes 52*a* through 52*d* and the tube joints 55*a* through 55*d*. The coating material is then ejected from the nozzles 56*a* through 56*d* and applied to the workpiece 32, while the coating material is being metered by valves (not shown) in the air cylinders 57*a* through 57*d*.

Figure 4:
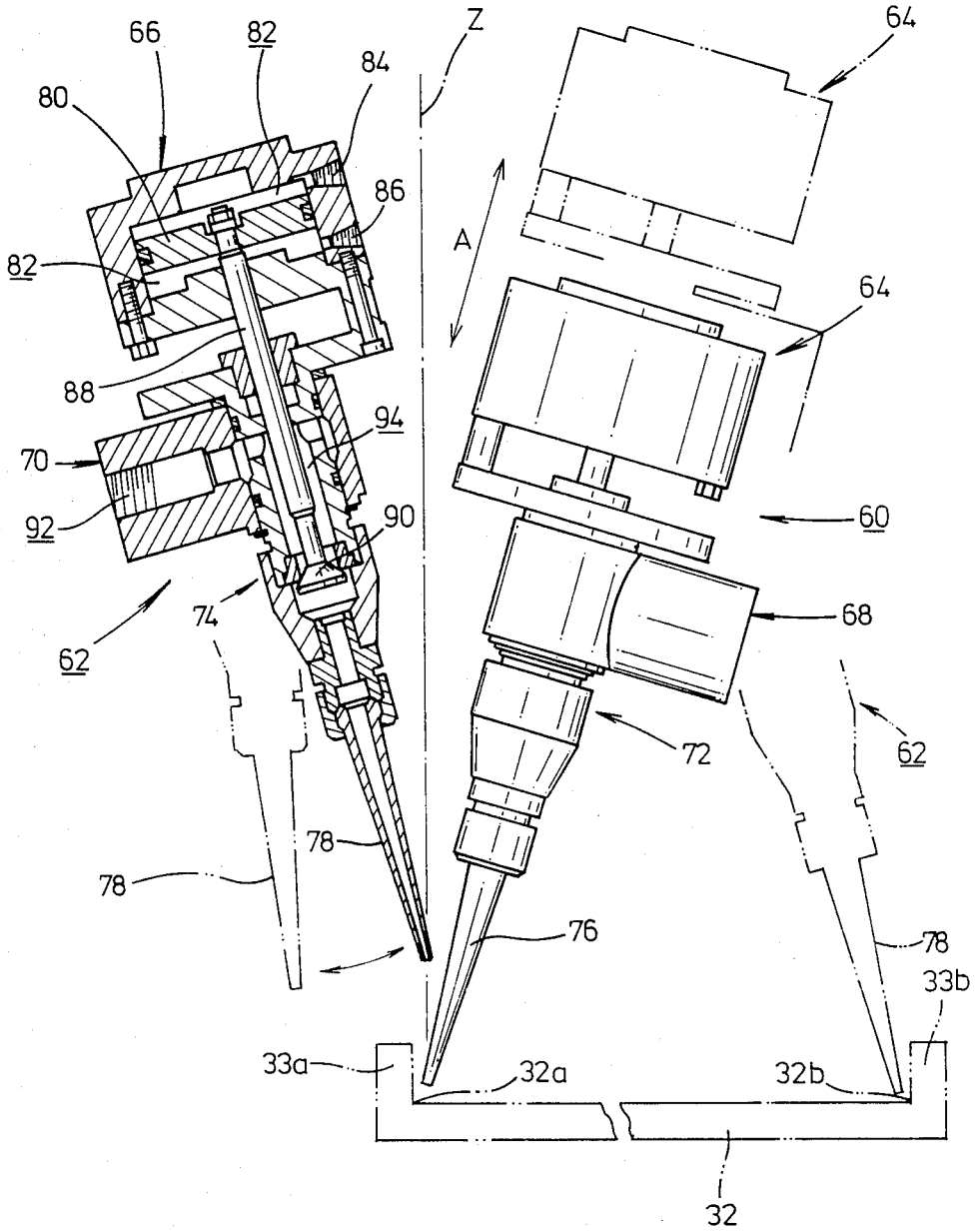
FIG. 4 is an enlarged elevational view of a nozzle device according to another embodiment of the present invention.

FIG. 4 shows a pair of nozzle devices 60, 62 according to another embodiment of the present invention, the nozzle devices 60, 62 being usable in place of any paired combination of the nozzle devices 42*a* through 42*d* and the nozzle devices 44*a* through 44*d* mounted on the Z-axis mobile bodies 38*a* through 38*d* shown in FIGS. 2 and 3. The nozzle devices 60, 62 are mounted on a coating unit so that their nozzles are inclined to the Z-axis direction and angularly displaced with respect to each other in close relationship. The nozzle device 60 is movable by a cylinder mechanism in the direction of the arrow A toward and away from the workpiece 32. The nozzle devices 60, 62 are moved upwardly and downwardly with the coating unit in the Z-axis direction. The nozzle devices 60, 62 are identical in structure, and comprise cylinders 64, 66, inlet members 68, 70, nozzle controllers 72, 74, and nozzles 76, 78, respectively. Since the nozzle devices 60, 62 are identical, only the nozzle device 60 will be described.

The cylinder 64 has a cylinder chamber 82 with a piston 80 slidably fitted therein, and two air inlet and outlet ports 84, 86 communicating with the cylinder chamber 82. To the piston 80, there is connected one end of a piston rod 88 with its opposite end extending into the nozzle controller 74, which includes a valve 90 mounted on the opposite end of the piston rod 88. The inlet member 70 has an inlet port 92 for introducing a coating material into the nozzle device 62, the inlet port communicating with a passage 94 defined in the nozzle controller 74. The valve 90 is axially movable by the piston rod 88 to open and close the passage 94 with respect to the nozzle 78.

The nozzle devices 60, 62 mounted on the coating unit will operate as follows: The nozzle device 60 is moved downwardly by the cylinder mechanism in the direction of the arrow A toward the workpiece 32, and then the coating unit is lowered in the Z-axis direction. Thereafter, the coating material is applied by the nozzle device 60 to the workpiece 32. At this time, the passage 94 in the nozzle device 62 is closed by the valve 90 to prevent the coating material from being ejected from the nozzle 78. The nozzle device 60 which is inclined to the Z-axis direction has the nozzle tip directed toward a corner 32*a* between the horizontal portion of the workpiece 32 and an upstanding rim 33*a*. The coating material is applied from the nozzle 76 to the corner 32*a* while the nozzle device 40 is moving along the corner 32*a*. Therefore, the coating material ejected from the nozzle device 60 can be applied reliably to the corner 32*a* without being obstructed by the upstanding rim 33*a*.

After the coating material has been applied by the nozzle device 60, the nozzle device 60 is raised by the cylinder mechanism in the direction of the arrow A, and then the nozzle device 62 is brought into a position for starting to coat the workpiece 32. Air under pressure is fed via the air inlet port 84 into the cylinder chamber 82 to displace the piston 80 and the piston rod 88 toward the nozzle 78, thus opening the passage 94 to allow communication between the inlet port 92 and the nozzle 78. Therefore, the coating material supplied to the inlet port 92 is delivered through the passage 94 to the nozzle 78, from which it is ejected toward the workpiece 32. The nozzle device 62 is also inclined at an angle to the nozzle device 60 so that the nozzle 78 is directed toward a corner 32*b* between the horizontal portion of the workpiece 32 and an upstanding rim 33*b* thereof which is opposite to the upstanding rim 33*a*. Thus, while the nozzle device 62 is running along the corner 32*b*, the coating material is neatly applied by the nozzle 78 to the corner 32*b* without being disturbed by the upstanding rim 33*b*. With the nozzle devices 60, 62 inclined to the Z-axis direction and angularly displaced with respect to each other, the coating material can be applied, without fail, to the corners 32*a*, 32*b* at the base of the upstanding rims 33*a*, 33*b* of the workpiece 32. The nozzle devices 60, 62 may be angularly movable as indicated by the two-dot-and-dash lines so that the nozzles 76, 78 can be inclined at different angles to the Z-axis direction and the direction of travel thereof. Consequently, both the corners 32*a*, 32*b* can be coated by either one of the nozzle devices 60, 62. The nozzle devices 60, 62 may also be equally positioned in the X and Y directions, thereby making it unnecessary to select individually the respective paths of travel of the nozzle devices 60, 62 in the X and Y directions. This is advantageous in that the teaching process for automatic control of the coating apparatus is simplified.

With the arrangement of the present invention, as described above in detail, a plurality of nozzles for ejecting coating materials are displaceable and selectively operated to coat the desired coating material on the workpiece for meeting a particular subsequent process to be effected on the workpiece. Therefore, the workpiece can be delivered into and out of the coating area in desired directions, so that the automatic coating apparatus may be installed in a relatively small space. Since the coating materials can quickly be changed by displacing a plurality of nozzle devices and selectively operating them, the different coating materials can efficiently be applied to the workpiece in a short period of time. As a modification, three or more nozzle devices may be mounted on a single coating unit.

Although certain preferred embodiments have been shown and described, it should be understood that many changes and modifications may be made therein without departing from the scope of the appended claims.

What is claimed:

1. An apparatus for automatically coating a workpiece, comprising:

at least one first track;

at least one Y-axis mobile body movable on and along said first track;

at least one second track mounted on said Y-axis mobile body and extending substantially perpendicularly to said first track;

at least one X-axis mobile body movable on and along said second track;

at least one third track mounted on said X-axis mobile body and extending substantially perpendicularly to said first and second tracks;

at least one Z-axis mobile body movable on and along said third track;

a plurality of nozzle devices mounted on said Z-axis mobile body and displaceable so as to be directed toward the workpiece;

actuating means for displacing said nozzle devices with respect to each other on each Z-axis mobile bodies wherein each of said nozzle devices is selectively, automatically displaceable with respect to the other nozzle device on each A-axis mobile body, said nozzle devices having respective nozzles for ejecting different coating materials;

means for selectively and independently operating one of said nozzles for first dispensing a coating material from said nozzle for a predetermined time; and means for selectively and independently operating the other nozzle device for dispensing a different coating material after termination of the first dispensing.

2. An apparatus according to claim 1, including four X-axis mobile bodies, four Y-axis mobile bodies, four Z-axis mobile bodies, said X-axis, Y-axis, and Z-axis mobile bodies being arranged in confronting pairs, and a pair of nozzle devices mounted on each of said Z-axis mobile bodies.

3. An apparatus according to claim 1, wherein said nozzle devices have respective nozzles extending parallel to said Z-axis mobile body.

4. An apparatus according to claim 1, wherein said nozzle devices have respective nozzles inclined to the direction of travel of said Z-axis mobible body and angularly displaced in close relationship to each other.

5. An apparatus according to claim 4, wherein said nozzle devices can freely be inclined to said Z-axis mobile body.

6. An apparatus according to claim 4, wherein said different coating materials are a mastic sealer and an adhesive, respectively.

7. An apparatus according to claim 6, wherein said workpiece is an automotive engine hood, said mastic sealer and said adhesive being applied to prescribed portions of said automotive engine hood.

8. An apparatus according to claim 1, wherein said X-axis, Y-axis, and Z-axis mobile bodies include respective servomotors for moving said X-axis, Y-axis, and Z-axis mobile bodies along said first, second, and third tracks, respectively.

9. An apparatus according to claim 2, wherein said actuating means is a cylinder mechanism for moving said nozzle devices with respect to each of said Z-axis mobile bodies.

10. An according to claim 1, wherein each of said nozzle devices comprises a cylinder mechanism, a valve openable and closable by said cylinder mechanism, a nozzle openable and closable by said valve, and means for delivering a coating material to said nozzle via said valve, whereby the amount of said coating material ejected from said nozzle can be regulated by operating said cylinder mechanism to adjust the opening of said valve.

* * * * *